United States Patent [19]

Hickman

[11] 4,195,432

[45] Apr. 1, 1980

[54] ADJUSTABLE MEANS TO VARY POINT OF IMPACT OF OVER-AND-UNDER FIREARMS

[76] Inventor: Jack L. Hickman, 1809 Plaza Way, Walla Walla, Wash. 99362

[21] Appl. No.: 935,585

[22] Filed: Aug. 21, 1978

[51] Int. Cl.[2] ..... F41C 21/06

[52] U.S. Cl. ..... 42/1 R

[58] Field of Search ..... 42/1 R, 1 S, 76 R

[56] References Cited

U.S. PATENT DOCUMENTS

| | | | |
|---|---|---|---|
| 2,949,825 | 8/1960 | Musser et al. | 42/1 S |
| 3,098,410 | 7/1963 | Giza | 42/1 S |
| 3,353,291 | 11/1967 | Musser | 42/1 S |
| 3,368,454 | 2/1968 | Peck et al. | 42/1 S |
| 3,550,300 | 12/1970 | Roder | 42/1 R |
| 3,955,299 | 5/1976 | Bullis | 42/1 R |
| 4,094,086 | 6/1978 | Gevers | 42/1 R |

*Primary Examiner*—Charles T. Jordan

*Attorney, Agent, or Firm*—Wells, St. John & Roberts

[57] ABSTRACT

An adjustable means interconnecting the muzzle ends of barrels in an over-and-under firearm to adjust the distance between the muzzle ends of the barrels to alter the point of impact of projectile means discharged from the barrels. The adjustable means includes an elongated yoke affixed to the upper barrel extending downwardly with a slot for receiving the lower barrel. A screw means is provided for adjusting the position of the lower barrel within the vertical slot of the yoke.

5 Claims, 3 Drawing Figures

ADJUSTABLE MEANS TO VARY POINT OF IMPACT OF OVER-AND-UNDER FIREARMS

BACKGROUND OF THE INVENTION

This invention relates to over-and-under shotgun firearms and more particularly to adjustment means for adjusting the relative position of the upper barrel and the lower barrel to alter the point of impact of projectiles discharged from the barrels.

Over-and-under shotguns are frequently used in shooting sports such as trap and skeet. The present invention is particularly useful for over and under shotguns used in the game of trap. Each individual shooter generally has his own preference as to the point of impact of the projectile in relation to the point of aim of the firearm. This may vary from shooter to shooter.

U.S. Pat. No. 3,955,299 granted May 11, 1976 to Douglas E. Bullis describes an adjustment means for an over-and-under firearm. The Bullis patent describes a turnbuckle arrangement and a transverse wedge arrangement for adjusting the respective distances between the upper barrel and the lower barrel. In both configurations it is relatively easy to put transverse pressure on the lower barrel and to bias the lower barrel out of vertical alignment with the upper barrel.

One of the principal objects of this invention is to provide adjustment means for an over-and-under shotgun that provides for very accurate and reliable alignment and adjustment.

These and other objects and advantages of this invention will become apparent upon reading the following detailed description of a preferred embodiment.

BRIEF DESCRIPTION OF THE DRAWINGS

The preferred embodiment of this invention is illustrated in the accompanying drawing, in which.

DETAILED DESCRIPTION OF A PREFERRED EMBODIMENT

Figure 1:
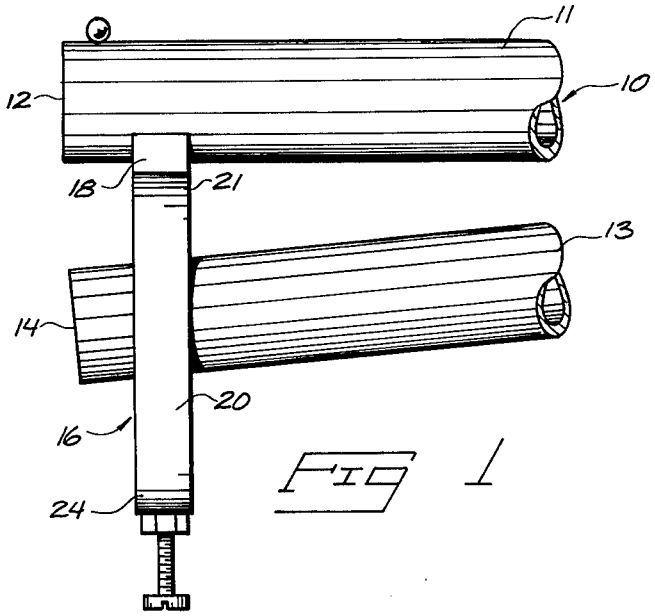
FIG. 1 is a fragmentary side view of the barrel ends of an over-and-under shotgun showing an adjustment means for adjusting the relative position of the muzzle ends.
Figure 2:
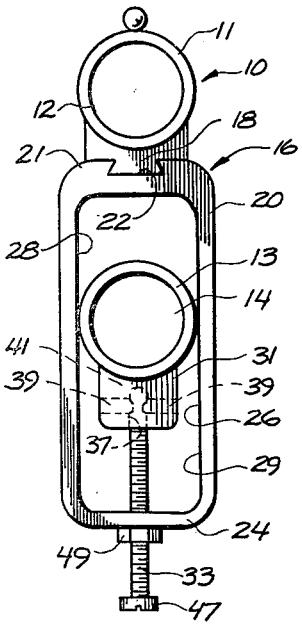
FIG. 2 is a front view showing the over-and-under shotgun as illustrated in FIG. 1.
Figure 3:
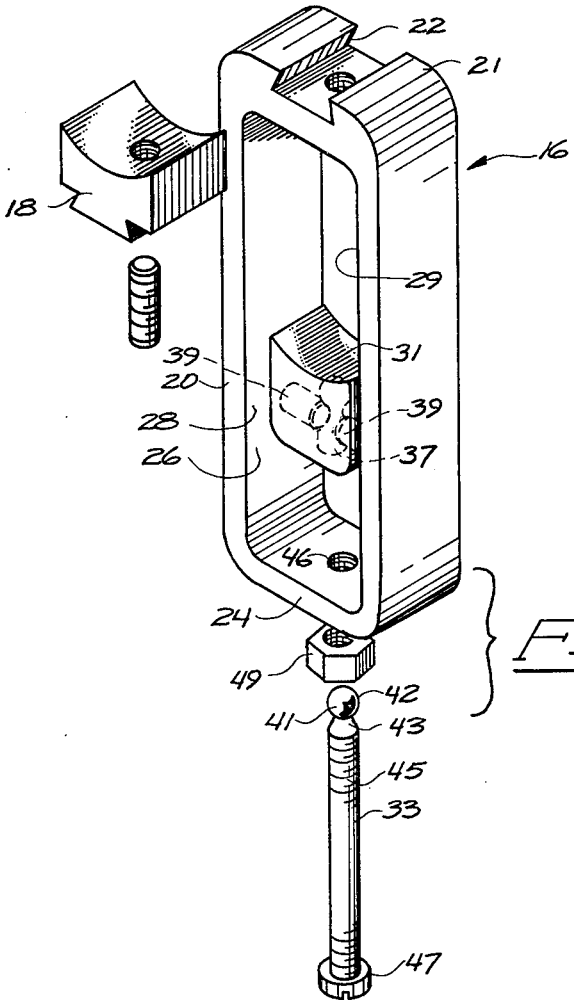
FIG. 3 is an isometric, exploded view of the adjustment means.

Referring now in detail to the drawings there is illustrated in FIG. 1 an over-and-under shotgun firearm 10 having an upper barrel 11 with an outer muzzle end 12. A lower barrel 13 is positioned or superimposed immediately below the upper barrel having a muzzle end 14 terminating adjacent the muzzle end 12. An adjustment means 16 operatively interconnects the muzzle ends 12 and 14 for adjusting the distance between the upper barrel 11 and the lower barrel 13 to vary the point of impact of projectiles fired from the lower barrel relative to the line of sight of the firearm. The adjustment means is affixed to the upper barrel 11 through a male dovetail way 18 that is positioned along the underside of the muzzle end 12. The way 18 is positioned longitudinally underneath the muzzle end 12.

The adjustment means 16 includes an elongated yoke 20 having an upper end 21 with a female dovetail way channel 22 formed therein for receiving the male dovetail way 18 to rigidly support the elongated yoke 20 on the upper barrel 11. The yoke extends downward terminating in a lower end 24 with a vertical slot 26 extending between the upper end 21 and the lower end 24. The slot 26 has a width dimension substantially corresponding to the diameter of the lower barrel 13 for guiding the lower barrel vertically with respect to the upper barrel 11. The yoke 20 has rail sides 28 and 29 that extend downwardly defining the sides of the slot 26. The rails 28 and 29 are substantially parallel with each other.

The adjustable means 16 further includes a connecting block 31 affixed to the underside of the lower barrel 13 and an adjustment screw 33 affixed to the lower end 24 of the yoke and interconnecting with the connecting block 31 to adjust the position of the lower barrel 13 within the vertical slot 26.

More specifically the connecting block 31 is affixed to the underside of the muzzle end 14 and extends downwardly having a downward slot 37 formed therein to receive the adjustment screw 33. Connecting means preferably in the form of set screws 39 are mounted in the connecting block 31 extending transverse to the slot 37 for securing the adjustment screw 33 to rotate within the slot 37. The adjustable screw 33 includes an upper end having a bulbous portion 42 that fits within the slot 37. Immediately below the bulbous portion is an indented groove 43 that is formed in the upper end 41. The set screws 39 extend into the indented groove 43 to secure the upper end 41 within the slot 37.

The adjustment screw has a threaded body 45 that is received within a threaded aperture 46 formed in the lower end 24 of the yoke. The adjustment screw 33 includes a screw head 47 that may be utilized to rotate the adjustment screw 33 about its longitudinal axis to move the connecting block up or down to adjust the position of the lower barrel 13.

The adjustment means 16 further includes a locking means 49 for locking the adjustment screw 33 in position to prevent its rotation once the desired location of the lower barrel is determined.

The adjustment screw 33 may be readily removed by backing out the set screws 39 to release the upper end 41 from the slot 37. Consequently the device can be readily repaired and adjusted. Additionally it may be easily mounted to an over-and-under shotgun with very little modification to the shotgun.

It should be understood that the above described invention is only illustrative of the principals of this invention and that numerous other embodiments may be readily devised without deviating therefrom. Only the following claims are intended to define the invention.

What is claimed is:

1. In a double barrel firearm having an upper barrel that is superimposed over a lower barrel, an adjustment means connecting said upper and lower barrels for varying the point of impact of projectiles fired from the lower barrel relative to the line of sight of the firearm, comprising:

an elongated yoke fixed to a muzzle end of the upper barrel and extending downward therefrom;

said elongated yoke having an elongated slot formed by parallel yoke side rails for receiving a muzzle end of the lower barrel therein and for enabling the muzzle end of the lower barrel to slide vertically along the rails within the slot;

adjustment means mounted on the yoke and operatively connected to the lower barrel for manually adjusting the relative position of the lower barrel within the elongated slot to adjust the relative distance between the muzzle ends of the barrels to vary the point of impact of projectiles fired from the lower barrel; and locking means associated with the adjustment screw for manually locking the adjustment screw to hold the lower barrel at a preset vertical position within the yoke slot.

2. In the double barrel firearm as defined in claim 1 wherein the adjustment means further comprises:

a connecting block affixed to the muzzle end of the lower barrel with the adjustment screw having an upper end affixed to the connecting block.

3. In the double barrel firearm as defined in claim 2 wherein the yoke has a vertical threaded aperture formed therein threadably receiving the adjustment screw for enabling the screw to threadably rotate about a vertical axis and to move axially within the aperture and wherein the connecting block includes connecting means operatively connected to the upper end of the adjustment screw for enabling the upper end to rotate with respect to the connecting block while moving the muzzle end of the lower barrel vertically in response to the axial movement of the adjustment screw.

4. In the double barrel firearm as defined in claim 1 wherein the muzzle end of the upper barrel includes a male dovetail way affixed thereto and wherein the yoke includes a complementary female dovetail way channel formed therein for receiving the male dovetail way to mount the yoke to the muzzle end of the upper barrel.

5. In the double barrel firearm as defined in claim 3 wherein the upper end of the adjustment screw has a bulbous portion and wherein the connecting block has adjustable set screws for engaging the bulbous portion to secure the bulbous portion to the connecting block.

* * * * *